US005883554A

United States Patent [19]

Takeuchi et al.

[11] Patent Number: 5,883,554

[45] Date of Patent: Mar. 16, 1999

[54] COAXIAL RESONATOR HAVING COUPLING ELECTRODES AND DIELECTRIC FILTER FORMED THEREFROM USING THE SAME

[75] Inventors: Kousuke Takeuchi; Yasumi Kobayashi; Yashuiro Hirao, all of Osaka-fu; Kenichi Shibata, Wakayama-ken; Kazuhiro Kuroki, Kyoto-fu, all of Japan

[73] Assignee: Sanyo Electric Co., Ltd., Moriguchi, Japan

[21] Appl. No.: 709,871

[22] Filed: Sep. 10, 1996

Related U.S. Application Data

[60] Continuation of Ser. No. 391,567, Feb. 21, 1995, abandoned, which is a division of Ser. No. 79,910, Jun. 23, 1993, abandoned.

[30] Foreign Application Priority Data

| | | | |
|---|---|---|---|
| Jun. 26, 1992 | [JP] | Japan | 4-169198 |
| Feb. 19, 1993 | [JP] | Japan | 5-055019 |

[51] Int. Cl.[6] ..... H01P 1/202

[52] U.S. Cl. ..... 333/202; 333/206; 333/222

[58] Field of Search ..... 333/202, 206, 333/207, 222, 223, 202 DB

[56] References Cited

U.S. PATENT DOCUMENTS

| | | | |
|---|---|---|---|
| 4,673,902 | 6/1987 | Takeda et al. | 333/206 |
| 4,757,288 | 7/1988 | West | 333/206 |
| 5,144,269 | 9/1992 | Itoh | 333/206 |
| 5,208,565 | 5/1993 | Sogo et al. | 333/206 |

FOREIGN PATENT DOCUMENTS

| | | | |
|---|---|---|---|
| 58-155104 | 10/1983 | Japan . | |
| 59-114902 | 7/1984 | Japan . | |
| 63-127607 | 5/1988 | Japan . | |
| 64-53601 | 3/1989 | Japan . | |
| 241203 | 9/1990 | Japan | 333/222 |
| 6103 | 1/1991 | Japan | 333/206 |
| 3-252201 | 11/1991 | Japan . | |
| 4-103203 | 4/1992 | Japan . | |
| 4-150101 | 5/1992 | Japan | 333/222 |
| 5-145302 | 6/1993 | Japan . | |

*Primary Examiner*—Benny Lee

*Attorney, Agent, or Firm*—Armstrong, Westerman, Hattori, McLeland & Naughton

[57] ABSTRACT

A coaxial resonator according to the present invention has an outer conductor on an outer peripheral surface of a dielectric block having at least four side surfaces and having a through hole provided in its approximately central part and an inner conductor on an inner peripheral surface of the through hole, and one of two end faces perpendicular to the through hole is opened and the other end face is short-circuited. A pair of an input electrode and an output electrode which are not brought into electrical contact with the outer conductor and are independent of each other is provided in a position in proximity to the opened end face on the outer peripheral surface of the dielectric block, and respective portions of both the electrodes are extended to the side surfaces, which are respectively adjacent to the electrodes, of the dielectric block. Consequently, the input electrode and the output electrode are capacitively coupled to each other, and the input electrode and the output electrode are respectively capacitively coupled to the inner conductor. Coupling capacitance can be adjusted by the areas of the electrodes.

10 Claims, 18 Drawing Sheets

COAXIAL RESONATOR HAVING COUPLING ELECTRODES AND DIELECTRIC FILTER FORMED THEREFROM USING THE SAME

This application is a continuation of application Ser. No. 08/391,567 filed Feb. 21, 1995, abandoned, which is a divisional of application Ser. No. 08/079,910 filed Jun. 23, 1993, now abandoned.

BACKGROUND OF THE INVENTION

1. Field of the Invention

The present invention relates generally to a coaxial resonator used as a filter in a microwave band and a dielectric filter constructed using the coaxial resonator.

2. Description of the Prior Art

As microwave remote communication has been put into practice, there has been a demand for communication equipment that is more lightweight and smaller in size; thereby, leading to a demand to miniaturize a duplexer which is an essential component in such an equipment.

Examples of a filter used for a duplexer in a microwave band generally includes a so-called coaxial resonator constituted by an outer conductor provided on an outer peripheral surface of a dielectric member having a through hole provided therein and an inner conductor provided on an inner peripheral surface of the through hole, and a strip-line type resonator using a strip line. As to the filters, a quarter-wavelength type filter which resonates at one-fourth of a wavelength at a resonance frequency f by producing the filter in one side short-circuited construction has been generally well known. In addition, a coaxial dielectric resonator constructed using a material having a high dielectric constant ($\in r$=40 to 90) has been widely used as one suitable for miniaturization.

Particularly in a portable telephone, a receiving band and a transmission band are used proximate to each other. Accordingly, a so-called polarized method having an attenuation pole is adopted for a filter for a duplexer. Examples of such a polarized method include a method of obtaining an anti-resonance frequency by connecting a capacitor or an inductor in series with a coaxial dielectric resonator (see Japanese Utility Model Laid-Open Gazette No. 4566/1987) and a method of coupling resonators which are not adjacent to each other (see Japanese Patent Laid-Open Gazette No. 108801/1988).

FIGS. 24A and 24B illustrate a polarized filter explaining the former method, where FIG. 24A is a perspective view showing the filter, and FIG. 24B is a diagram showing an equivalent circuit thereof. Three coaxial resonators are used to fabricate a polarized band-pass filter. In this polarized band-pass filter, three coaxial resonators 62 are provided on a dielectric substrate 61 (see, FIG. 24A). Anti-resonance capacitances 63*a*, 63*b* and 63*c* (see FIG. 24B) are respectively connected to the coaxial resonators 62. In addition, chip capacitors 64*a* to 64*d* are provided on the dielectric substrate 61. The two chip capacitors 64*b* and 64*c* out of the chip capacitors 64*a* to 64*d* are inter-stage coupling capacitors for coupling the coaxial resonators to each other.

However, in the above described filter shown in FIG. 24A and 24B, an inter-stage coupling portion is required. Accordingly, the dielectric substrate 61 must be made relatively large so as to form the inter-stage coupling portion, thereby making it impossible to miniaturize the filter. On the other hand, in the above described method of coupling the resonators which are not adjacent to each other, a jump coupling substrate is required, thereby similarly making it impossible to miniaturize the filter.

SUMMARY OF THE INVENTION

The present invention has been made in view of the above described circumstances and has for its object to provide a small-sized dielectric filter and to provide a coaxial resonator used for the small-sized dielectric filter.

The coaxial resonator on this invention includes a dielectric block having at least four side surfaces, wherein such dielectric block includes an outer peripheral surface and an inner peripheral surface parallel to each other along a common axis, and further includes first and second end faces crossing the axis. The coaxial resonator further includes first and second conductor layers coated with the outer peripheral surface and the inner peripheral surface; a third conductor layer on the second end face for short-circuiting the first and second conductor layers; and an input electrode and an output electrode, on the outer peripheral surface in a position in proximity to the first end face, are not brought into electrical contact with the first conductor layer, and are independent of each other.

The dielectric filter of this invention can include a plurality of coaxial resonators, which are provided side by side. Each of the coaxial resonators includes a dielectric block having at least four side surfaces, wherein each of the coaxial resonators includes an outer peripheral surface and an inner peripheral surface parallel to each other along a common axis, and has first and second end faces crossing the axis, first and second conductor layers coated with the outer peripheral surface and the inner peripheral surface, a third conductor layer on the second end face for short-circuiting the first and second conductor layers, and an input electrode and an output electrode, which are formed on the outer peripheral surface in a position in proximity to the first end face, are not brought into electrical contact with the first conductor layer, and are independent of each other. Each of the coaxial resonators includes means for positioning the input electrodes and the output electrodes in the respective coaxial resonators in a similar plane, arranging the first end faces and the second end faces in respective coaxial resonators in a similar direction, and electrically connecting the input electrode and the output electrode in the adjacent coaxial resonators to each other.

The method for adjusting coupling capacitances in a coaxial resonator in this invention includes the steps of changing the areas of an input electrode and/or an output electrode in the coaxial resonator; and adjusting coupling capacitances of the input electrode and/or the output electrode and a second conductor layer. The dielectric block in this method includes at least four side surfaces, an outer peripheral surface and an inner peripheral surface parallel to each other along a common axis, and first and second end faces crossing the axis, first and second conductor layers with which the outer peripheral surface and the inner peripheral surface are respectively coated, a third conductor layer on the second end face for short-circuiting the first and second conductor layers, and an input electrode and an output electrode which are formed on the outer peripheral surface in a position in proximity to the first end face, are not brought into electrical contact with the first conductor layer, and are independent of each other.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS (Embodiment 1)

Figure 1:
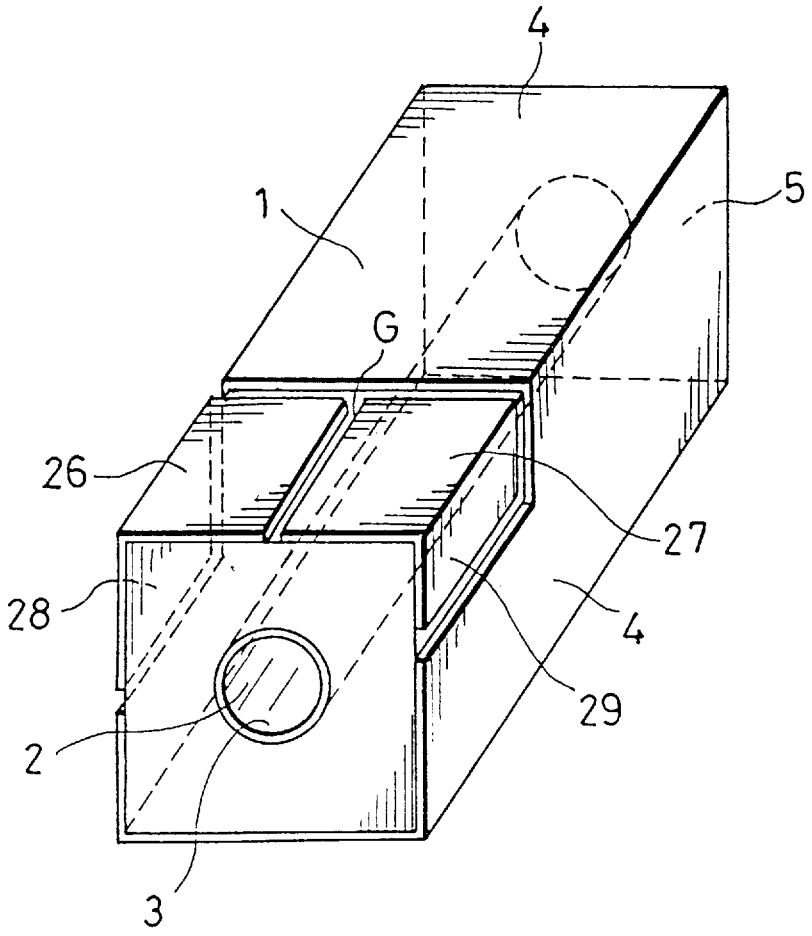
FIG. 1 is a perspective view showing an element structure of a coaxial resonator according to the present invention.

As shown in FIG. 1, a dielectric block 1 is in a rectangular parallelepiped shape, and is constituted by a dielectric member (the dielectric constant is 38) composed of, for example, ceramics of a $TiO_2$—$SnO_2$—$ZrO_2$ system. The dielectric block 1 has a through hole 2 provided in the longitudinal direction in its central part. In addition, an inner peripheral surface of the above described through hole 2 is coated with a conductive member (such as silver), so as to form an inner conductor 3. On the other hand, an outer peripheral surface of the dielectric block 1 is similarly coated with a conductive member (such as, silver), so as to form an outer conductor 4.

One of two end faces perpendicular to the above described through hole 2 is opened, while the other end face is short-circuited. Specifically, a short-circuit electrode 5 is formed on the rear surface of the dielectric block 1 to be a termination of the through hole 2, so as to short-circuit this coaxial resonator.

The outer conductor 4 is removed on the whole on the side of the opened end face of one side surface of the dielectric block 1 and on a part on the side of the opened end face of side surfaces adjacent to the one side surface, and an input electrode 26 and an output electrode 27 are formed with a gap G parallel to the axial direction of the coaxial resonator being provided therebetween in this removed portion on the above described one side surface. Specifically, predetermined spacing is formed between both opposed edges of the input electrode 26 and the output electrode 27, and the opposed edges are respectively parallel to the axial direction of the coaxial resonator. An extended portion 28 extended from the input electrode 26 is formed in the removed portion on the side surface adjacent to the one side surface, and an extended portion 29 extended from the output electrode 27 is formed in the removed portion on the other side surface adjacent to the one side surface.

As the typical dimensions of the above described coaxial resonator, the length is approximately 4.8 mm, and the respective lengths of sides in cross section are approximately 3 mm. In actually connecting the coaxial resonator to the other element, the coaxial resonator shown in FIG. 1 is mounted thereon upside down.

Figure 2:
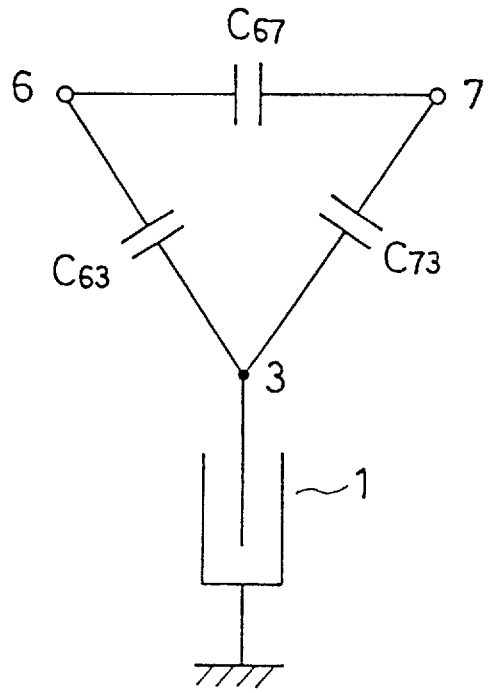
FIG. 2 is a diagram showing an equivalent circuit of the coaxial resonator according to the present invention.

In the coaxial resonator of such construction, capacitive coupling as shown in an equivalent circuit diagram of FIG. 2 is formed specifically, a capacitance $C_{67}$ is formed between the input electrode 6 and the output electrode 7, and capacitances $C_{63}$ and $C_{73}$ are respectively formed between the input electrode 6 and the output electrode 7 and the inner conductor 3 in the coaxial resonator 1. The same portions as those shown in FIG. 1 are assigned the same reference numerals in FIG. 2. Particularly in the coaxial resonator according to the present invention, capacitance values obtained by the capacitive coupling can be changed into desirable capacitance values by adjusting the areas of the electrodes and the like used in the coaxial resonator.

For example, since in the case of a dielectric resonator having a dielectric constant of 38, having sides each having a length of 3 mm, and having an inner diameter of 1 mm, the distance from the outer peripheral surface to the inner conductor is approximately 1 mm, the area of each of the electrodes may be 9 $mm^2$ so as to obtain a capacitance value of approximately 3 pF as the capacitances $C_{63}$ and $C_{73}$. At this time, if the length of the gap between the input and output electrodes is 0.1 mm and the width of each of the electrodes is 2 mm, it is possible to obtain a capacitance value of approximately 5 pF as the capacitance $C_{67}$.

Figure 3:
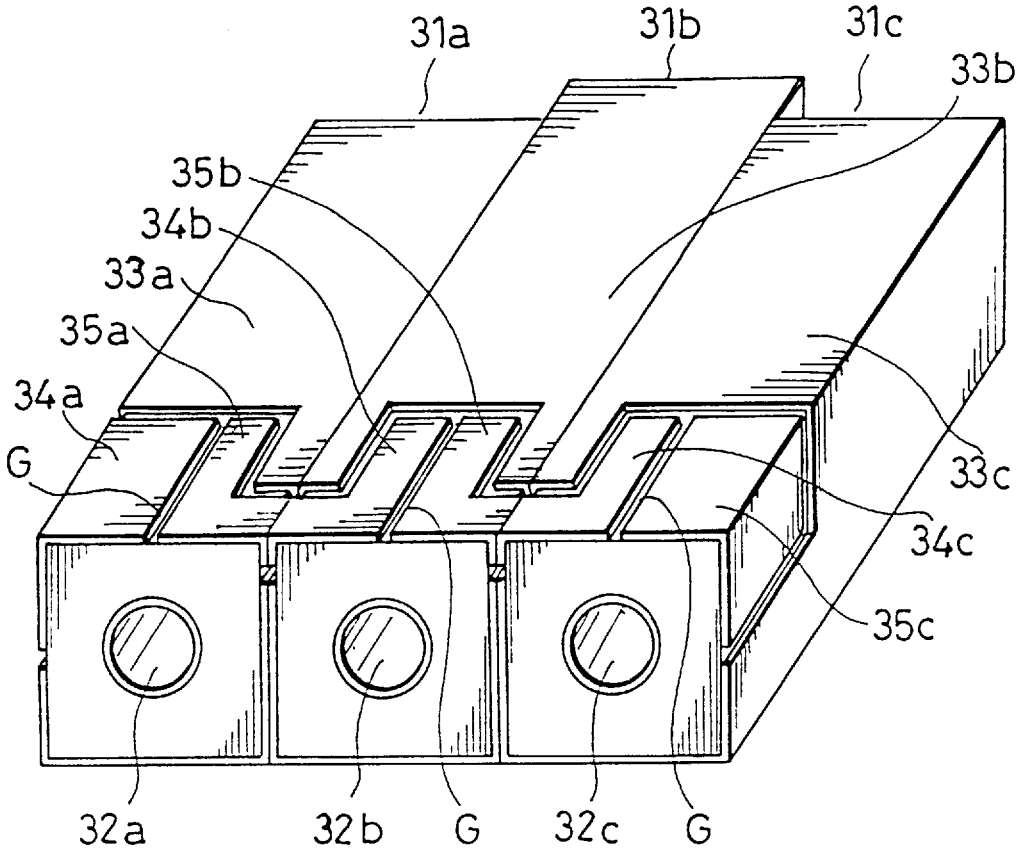
FIG. 3 is a perspective view showing an element structure of a dielectric filter according to the present invention.

A dielectric filter according to the present invention will be described with reference to FIG. 3. FIG. 3 illustrates a dielectric filter (a perspective view) in which a plurality of coaxial resonators as described above according to the present invention are provided side by side. Coaxial resonators 31*a,* 31*b* and 31*c* in FIG. 3 are respectively the above described coaxial resonator according to the present invention shown in FIG. 1, and inner peripheral surfaces of dielectric block through-holes are respectively provided with inner conductors 32*a,* 32*b* and 32*c* coated with a conductive member such as silver. Outer peripheral surfaces of the dielectric blocks are respectively provided with outer conductors 33*a,* 33*b* and 33*c* coated with a conductive member such as silver. In addition, input electrodes 34*a,* 34*b* and 34*c* are provided on respective one side surfaces of the coaxial resonators 31*a,* 31*b* and 31*c,* and output electrodes 35*a,* 35*b* and 35*c* are provided on the same side surfaces. The output electrodes 35*a,* 35*b* and 35*c* and the input electrodes 34*a,* 34*b* and 34*c* are respectively opposed to each other with a corresponding gap G parallel to the axial direction of each of the coaxial resonators being provided therebetween.

The respective input and output electrodes are so formed as to be extended to side surfaces which are respectively adjacent to the input and output electrodes, as in the above described coaxial resonator according to the present invention. Therefore, extended portions of the input electrode 35*a* and the output electrode 34*b* are brought into close contact with each other in order to attain the electrical connection between the coaxial resonator 31*a* and the coaxial resonator 31*b,* which cannot be directly seen in FIG. 3. The same is true for the connection between the coaxial resonator 31*b* and the coaxial resonator 31*c*. As a specific method, the coaxial resonators are brought into close contact with each other, for example, by soldering or with the use of adhesives. The input electrode 34*a* and the output electrode 35*c* respectively function as input and output electrodes of the coaxial resonators and at the same time, also respectively function as input and output electrodes of the dielectric filter according to the present invention.

Furthermore, as described in the embodiment shown in FIG. 1, in a case where the above described capacitance values are adjusted by the areas of the electrodes, it is preferable that the shapes and the areas of both the above described electrodes in close contact with each other in the plurality of coaxial dielectric resonators which are adjacent to each other are made equal to each other. Specifically, when the areas are equal to each other but the shapes are different from each other, both the electrodes cannot be completely brought into contact with each other over the whole areas irrespective of an attempt to bring both the electrodes into contact with each other by providing the dielectric resonators side by side, which causes capacitances or the like to vary to adversely affect the characteristics.

Figure 4A:
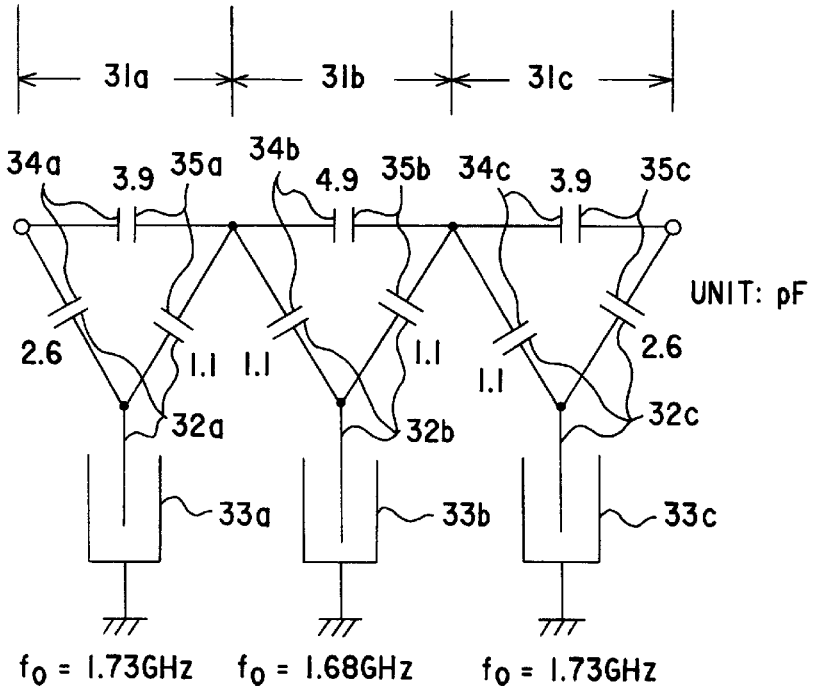
FIGS. 4A and 4B are diagrams showing an equivalent circuit of the dielectric filter according to the present invention.
Figure 4B:
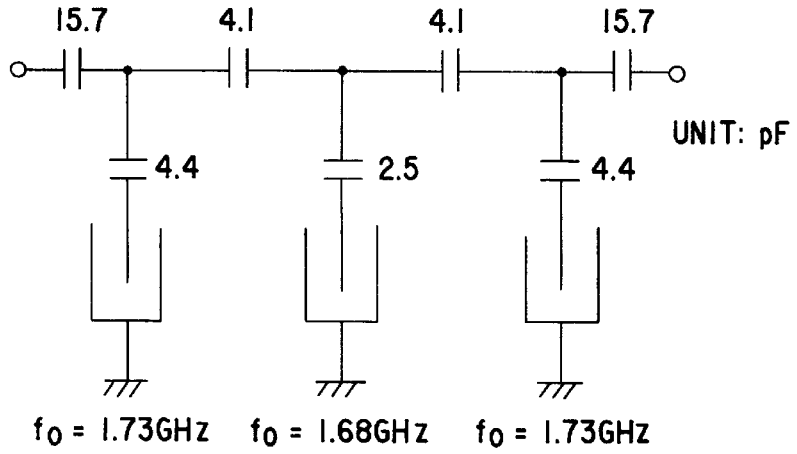

FIGS. 4A and 4B are diagrams showing an equivalent circuit of the above described dielectric filter. FIG. 4A is a diagram based on the three capacitances in the equivalent circuit described in FIG. 2, and FIG. 4B is a diagram obtained by subjecting the equivalent circuit to Y–Δ conversion. 31*a,* 31*b* and 31*c* in FIG. 4A are illustrated to respectively correspond to the coaxial resonators 31*a,* 31*b* and 31*c* shown in FIG. 3. Furthermore, in, for example, the coaxial resonator 31*a,* the capacitance value of the capacitance $C_{67}$ in FIG. 2 is 3.9 pF, and the capacitance values of the capacitances $C_{63}$ and $C_{73}$ are respectively 2.6 pF and 1.1 pF.

FIG. 4A also illustrates that the capacitance made by an input electrode 34*a* and an inner conductor 32*a* of a coaxial resonator 31*a* is 2.6 pF, the capacitance made by an input electrode 34*b* and an inner conductor 32*b* of a coaxial resonator 31*b* is 1.1 pF, and the capacitance made by an input-electrode 34*c* and an inner conductor 32*c* of a coaxial resonator 31*c* is 1.1 pF. See, the capacitance values shown in the left side portions of the inverse triangles in FIG. 4A.

FIG. 4A further shows that the capacitance made by an output electrode 35*a* and an inner conductor 32*a* of a coaxial resonator 31*a* is 1.1 pF, the capacitance made by an output electrode 35*b* and an inner conductor 32*b* of a coaxial resonator 31*b* is 1.1 pF, and the capacitance made by an output electrode 35*c* and an inner conductor 32*c* of a coaxial resonator 31*c* is 2.6 pF. See, the capacitance values shown in the right side portions of the inverse triangles in FIG. 4A.

$f_0$=1.73 GHz shown in the left side of FIG. 4A means resonating frequency of a coaxial resonator 31*a*. $f_0$=1.68 GHz shown in the center part of FIG. 4A means resonating frequency of a coaxial resonator 31*b*. $f_0$=1.73 GHz shown in the right side of FIG. 4A means resonating frequency of a coaxial resonator 31*c*.

Each value shown in FIG. 4B means each value of each capacitance (pF). Each capacitance is obtained by subjecting FIG. 4A to Y–Δ conversion.

$f_0$=1.73 GHz shown in the left side of FIG. 4B means resonating frequency of a coaxial resonator 31*a*. $f_0$=1.68 GHz shown in the center portion of FIG. 4B means resonating frequency of a coaxial resonator 31*b*. $f_0$=1.73 GHz shown in the right side of FIG. 4B means resonating frequency of a coaxial resonator 31*c*.

After the Y conversion, capacitances of 15.7 pF, 4.1 pF, 4.1 pF and 15.7 pF exist in series with a transmission line, in this order. Another capacitances of 4.4 pF exists between, each of the capacitances of 15.7 pF and 4.1 pF in parallel with the transmission line. Still another capacitance of 2.5 pF exists between the capacitances of 4.1 pF and 4.1 pF in parallel with the transmission line.

Meanwhile, numerical values in the equivalent circuit are examples in a polarized filter for receiving with respect to a portable telephone in a 1.5 GHz band.

Although a large capacitance value of approximately 15.7 pF can be similarly obtained in respective capacitances of an input and an output in FIG. 4 (b), it is difficult to obtain such large capacitance values in the conventional dielectric filter comprising coaxial resonators.

Figure 5:
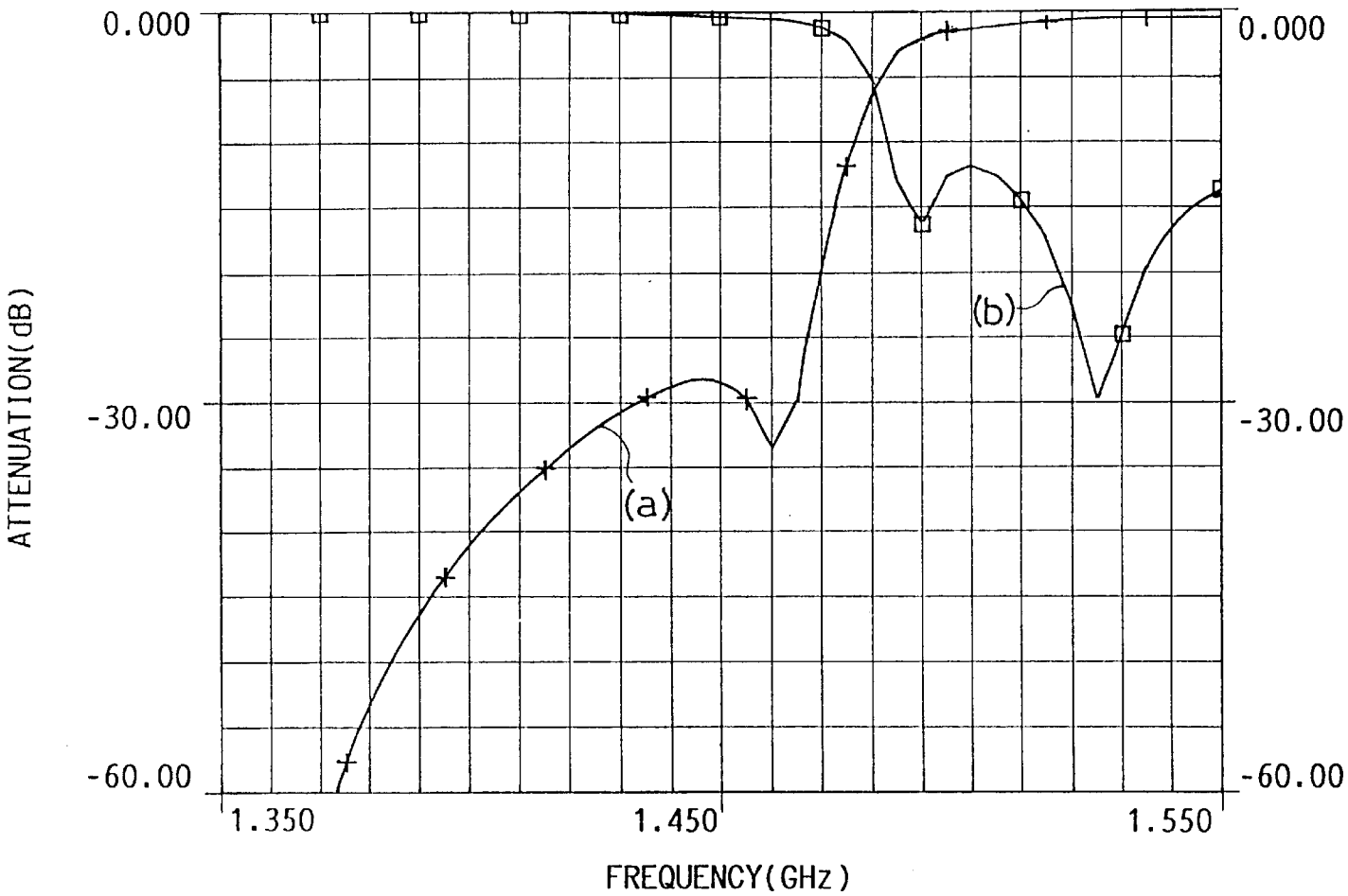
FIG. 5 is a diagram showing the representative characteristics of the dielectric filter according to the present invention.

FIG. 5 is a diagram showing the frequency characteristics of a filter obtained by polarizing the above described dielectric filter in a low frequency band. In FIG. 5, a graph (a) shows the propagation characteristics of the filter, and a graph (b) shows the reflection loss. That is, graph (b), in FIG. 5, shows return loss at the input terminal of the filter. At the condition of 0 dB, the whole energy is reflected on the input terminal. As shown in FIG. 5, an attenuation pole is formed in a suppressed band having a frequency which is made lower than the center frequency 1.507 GHz of a pass band by 36 MHz, to obtain a suppression level of not less than −30 dB. It is possible to confirm the effectiveness of the dielectric filter according to the present invention.

Also, in the dielectric filter according to the present invention, in connecting the dielectric filter to the other element, the dielectric filter shown in FIG. 3 is mounted thereon upside down, as described in the coaxial dielectric resonator shown in FIG. 1.

(Embodiment 2)

A second embodiment will be described with reference to FIGS. 6 to 14.

Figure 6:
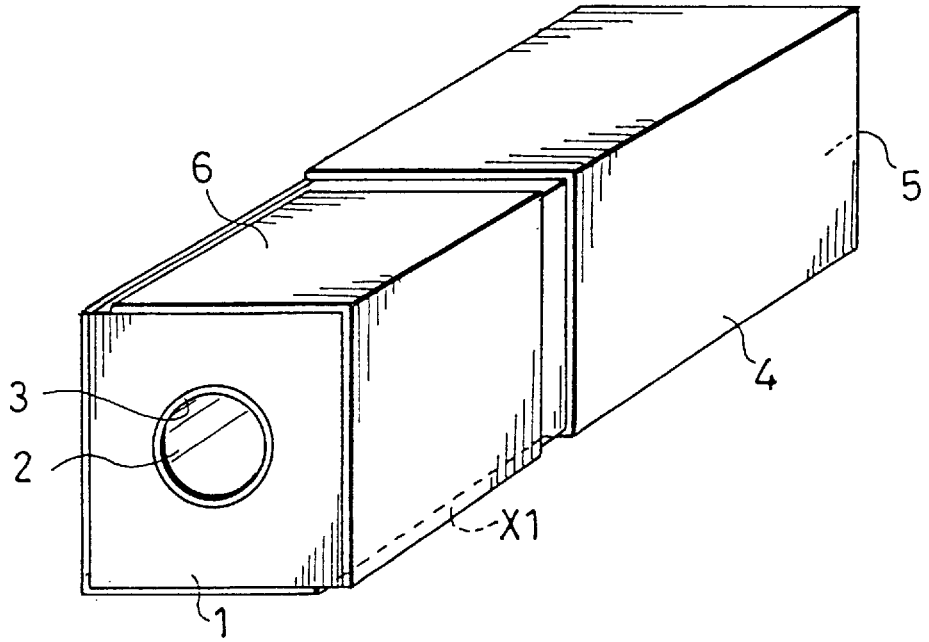
FIG. 6 is a perspective view showing a coaxial resonator which comprises a conductor for capacitance according to the present invention and is used for input or output.
Figure 7:
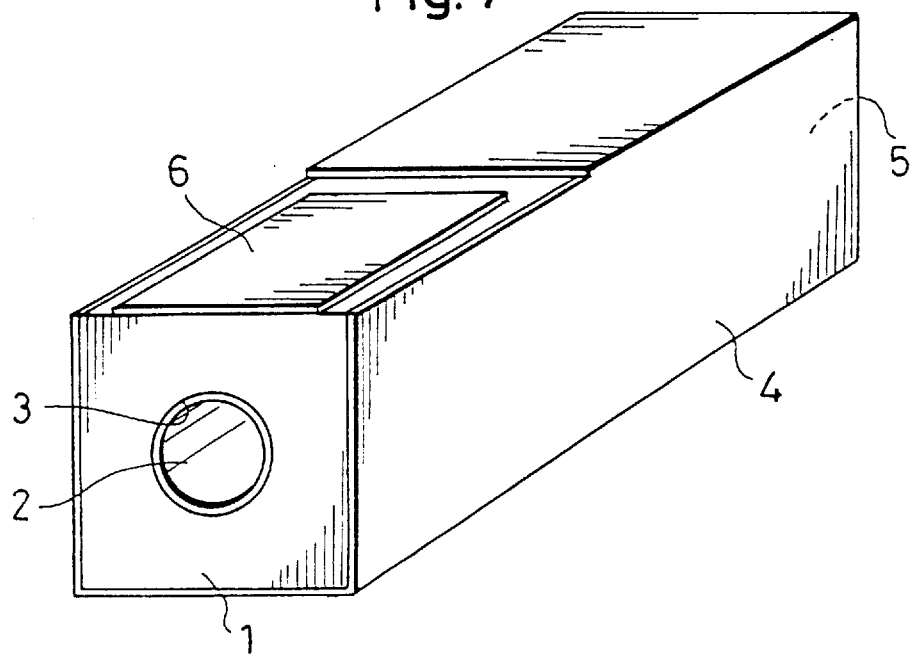
FIG. 7 is a perspective view showing a coaxial resonator which comprises a conductor for capacitance according to the present invention and is used for purposes other than input or output.

As shown in FIGS. 6 and 7, a dielectric block 1 is in a rectangular parallelopiped shape having dimensions of approximately 3 mm long×3 mm wide×7 mm deep, and is constituted by a dielectric member (the dielectric constant is 38) composed of, for example, ceramics of a $TiO_2$—$SnO_2$—$ZrO_2$ system. The dielectric block 1 has a through hole 2 having a diameter of 1 mm provided in the longitudinal direction in its central part. In addition, an inner peripheral surface of the above described through hole 2 is coated with a conductive member (such as silver), in order to form an inner conductor 3. On the other hand, an outer peripheral surface of the dielectric block 1 is similarly coated with a conductive member (such as silver) in order to form an outer conductor 4.

One of two end faces perpendicular to the above described through hole 2 is opened, while the other end face is short-circuited. Specifically, a short-circuit electrode 5 is formed on the rear surface of the dielectric block 1 to be a termination of the through hole 2, to short-circuit this coaxial resonator.

An independent conductor for capacitance 6 which is composed of a conductive member such as silver and is spaced apart from the above described outer conductor 4 by a distance of 0.2 mm so as not to be brought into electrical contact with the outer conductor 4 is formed in a position in proximity to the above described opened end face on the outer peripheral surface of the dielectric block 1. The coaxial resonator shown in FIG. 6 is for input or output, and the conductor for capacitance 6 is formed over two surfaces, (i.e., the upper surface and the side surface). On the other hand, the coaxial resonator shown in FIG. 7 is for purposes other than input or output, and the conductor for capacitance 6 is formed only on the upper surface. In the present embodiment, the conductor for capacitance 6 on the above described side surface in the coaxial resonator for input or output shown in FIG. 6 is extended to the lower end of the side surface, and a notch X1 indicated by a dotted line in FIG. 6 is formed on the bottom surface of the coaxial resonator so that the outer conductor 4 formed on the bottom surface is not brought into electrical contact with the conductor for capacitance 6 formed on the above described side surface. The conductor for capacitance 6 is thus extended to the lower end of the side surface; thereby, making it easy to connect the coaxial resonator and the other element to each other on a substrate.

As to FIG. 7, reference numerals 1, 2, 3, 4, 5 in FIG. 7 indicate the same parts as those in FIG. 6.

Figure 8:
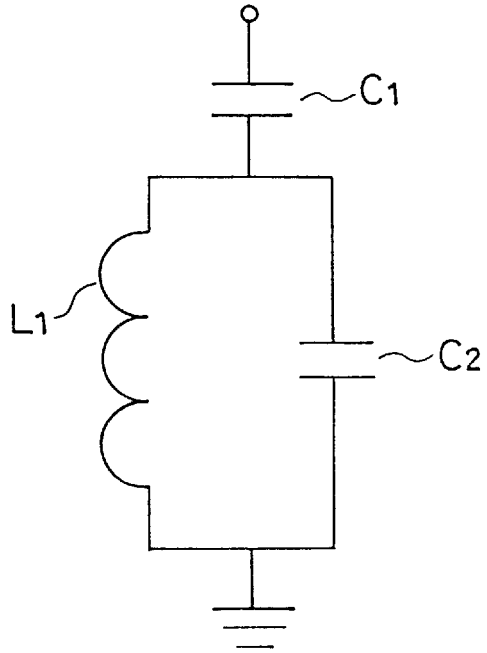
FIG. 8 is a diagram showing an equivalent circuit of the coaxial resonator comprising the conductor for capacitance according to the present invention.

FIG. 8 is a diagram showing an equivalent circuit of the above described coaxial resonator. In FIG. 8, $C_1$ is a capacitance produced between the conductor for capacitance 6 and the inner conductor 3 of the resonators in FIGS. 6 and 7. Specifically, since the conductor for capacitance 6 is formed on the side of the opened end face, an electric field is dominant so that the conductor for capacitance 6 can be regarded as substantial capacitive coupling. In addition, $C_2$ and $L_1$ are equivalent representations of the characteristics of a coaxial transmission line having one side which is short-circuited and is constituted by the inner conductor 3 and the outer conductor 4 by a parallel circuit of a capacitance and an inductance.

Figure 9:
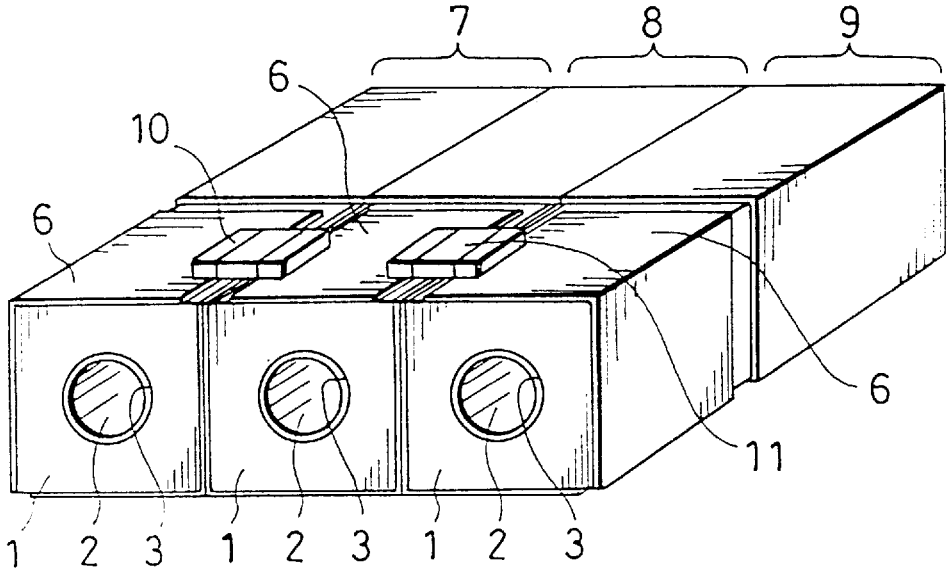
FIG. 9 is a perspective view showing a dielectric filter constructed by arranging three coaxial resonators each comprising the conductor for capacitance according to the present invention side by side and coupling the coaxial resonators to each other by chip capacitors.

FIG. 9 is a perspective view showing a dielectric filter constituted by three coaxial resonators, where both sides of the coaxial resonators 7 and 9 are coaxial resonators for input or output and of construction shown in FIG. 6, and the coaxial resonator 8 in the center is a coaxial resonator of construction shown in FIG. 7. Each of the coaxial resonators comprises a conductor for capacitance 6 on its upper surface. The conductors for capacitance 6 are respectively extended as electrodes for input or output on the side surfaces in the coaxial resonators 7 and 9 on both sides. The coaxial resonators 7, 8 and 9 are arranged in such a way that all or a part of the conductors for capacitance 6 in the respective coaxial resonators exist on the above described upper surfaces, the opened end faces and the short-circuited end faces in the respective coaxial resonators are arranged in the same direction, and the outer conductor 4 on the side surface in at least one of the coaxial resonators is brought into contact with the outer conductor on the side surface in the adjacent coaxial resonator. A chip capacitor 10 is carried between the conductor for capacitance 6 in the coaxial resonator 7 and the conductor for capacitance 6 in the coaxial resonator 8, and a chip capacitor 11 is carried between the conductor for capacitance 6 in the coaxial resonator 8 and the conductor for capacitance 6 in the coaxial resonator 9.

Reference numerals 1, 2, 3 indicate the same parts as those in FIG. 6.

Figure 10:
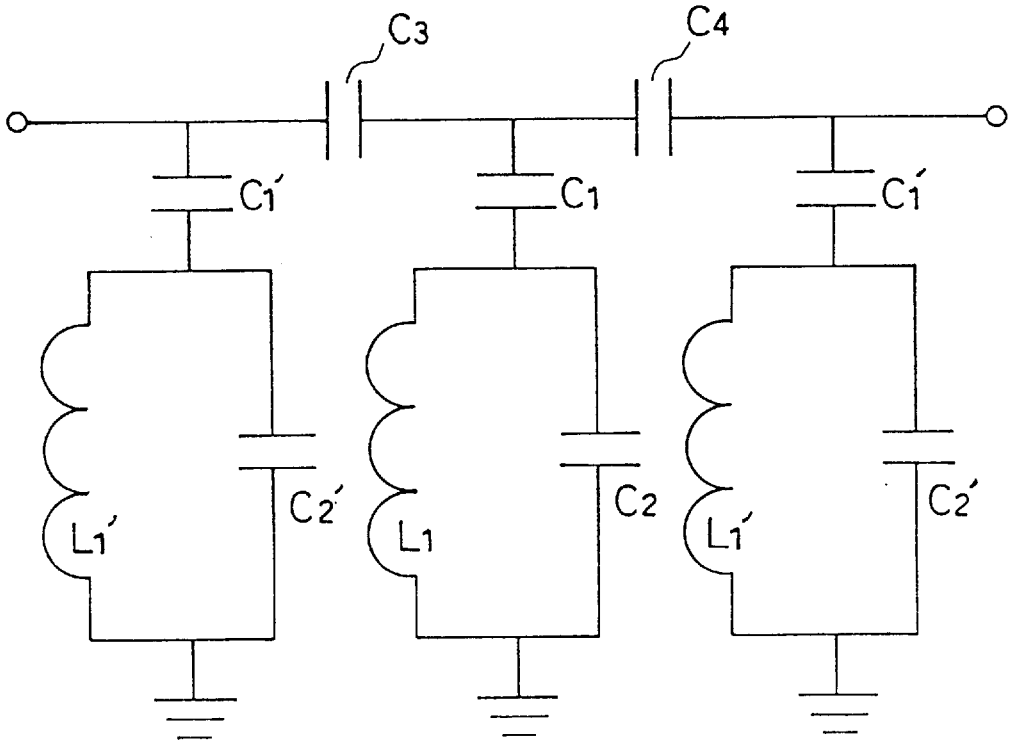
FIG. 10 is a diagram showing an equivalent circuit of the dielectric filter shown in FIG. 9.
Figure 11:
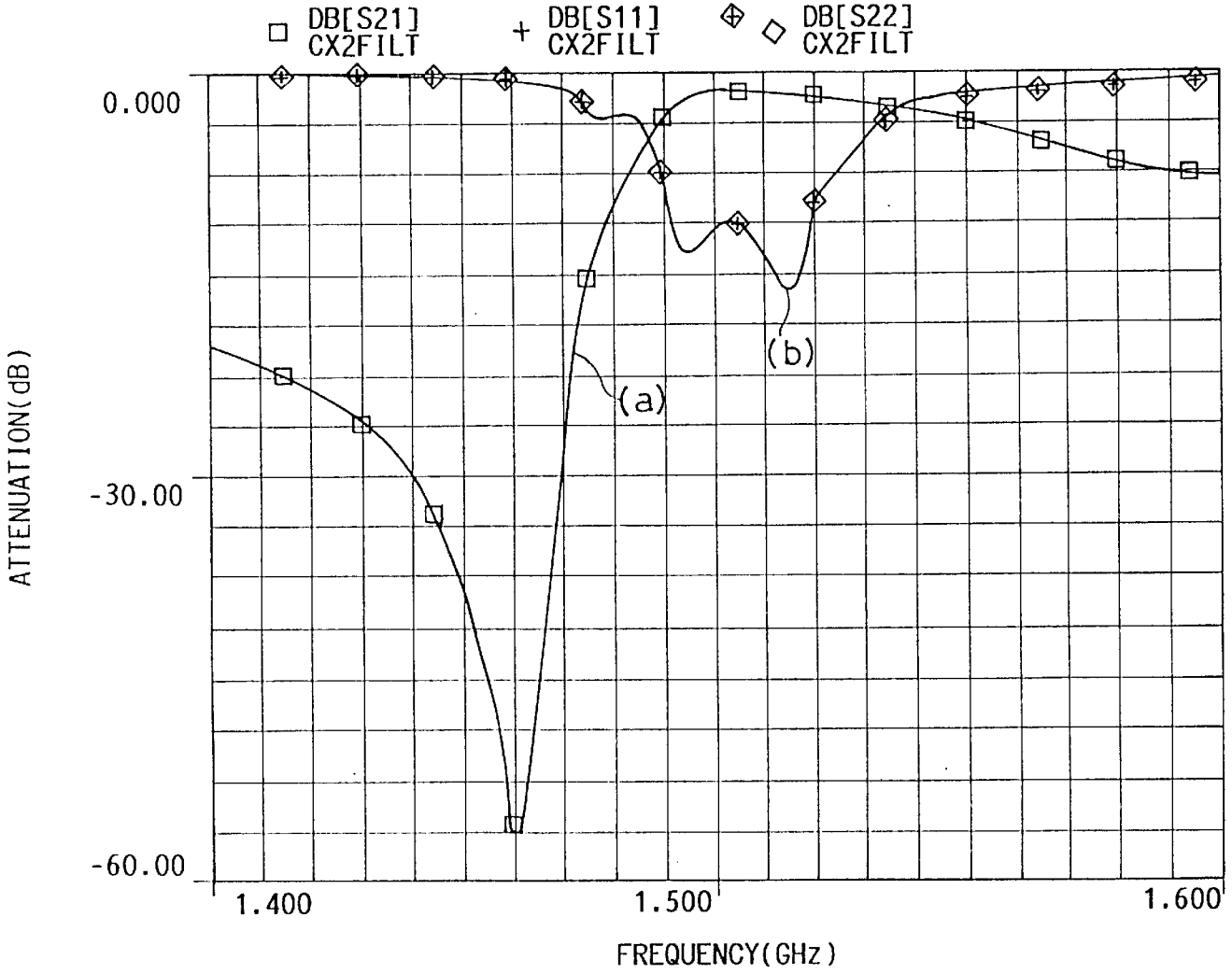
FIG. 11 is a diagram showing the representative characteristics of the dielectric filter shown in FIG. 9.

FIG. 10 is a diagram showing an equivalent circuit of the above described dielectric filter. In FIG. 10, $C_3$ and $C_4$ respectively indicate capacitances of the chip capacitors 10 and 11. In addition, FIG. 11 is a diagram showing the frequency characteristics of the above described dielectric filter. A graph (a) shows the propagation characteristics of the filter, and a graph (b) shows the reflection loss. As can be seen from FIG. 11, an attenuation pole is formed in a 1.46 GHz band in order to obtain a suppression level of approximately −75 dB so that the dielectric filter has a function of a polarized band-pass filter. In the dielectric filter exhibiting the above-described characteristics, used as the above described chip capacitors 10 and 11 (see, FIG. 9) are ones respectively having capacitances $C_3$ and $C_4$ of 2 pF. In addition, the area of each of the conductors for capacitance 6 in the coaxial resonators 7 and 9 for input or output is taken as 20 $mm^2$ so that $C_1'$=2 pF, $C_2'$=7 pF, and $L_1'$=1.6 nH (see, FIG. 10). On the other hand, the area of the conductor for capacitance 6 in the coaxial resonator for purposes other than input or output is taken as 10 $mm^2$ so that $C_1$=1 pF, $C_2$=7 pF, and $L_1$=1.6 nH (see, FIG. 10).

Figure 12:
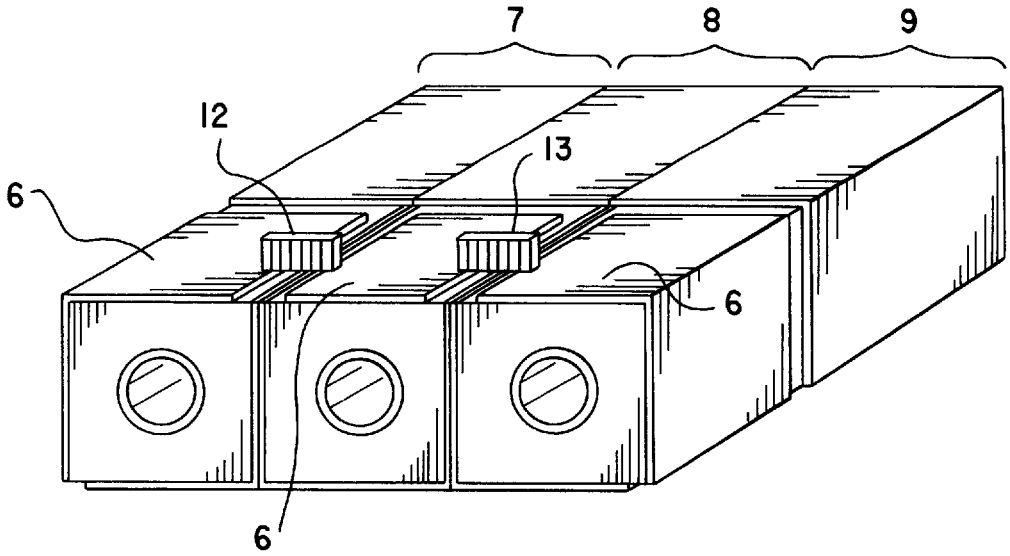
FIG. 12 is a perspective view showing a dielectric filter constructed by arranging three coaxial resonators each comprising the conductor for capacitance according to the present invention side by side and coupling the resonators to each other by chip coils.

FIG. 12 is a perspective view showing a dielectric filter using chip coils 12 and 13 as reactance. Specifically, the chip coil 12 is carried between the conductor for capacitance 6 in the coaxial resonator 7 and the conductor for capacitance 6 in the coaxial resonator 8, and the chip coil 13 is carried between the conductor for capacitance 6 in the coaxial resonator 8 and the conductor for capacitance 6 in the coaxial resonator 9.

Figure 13:
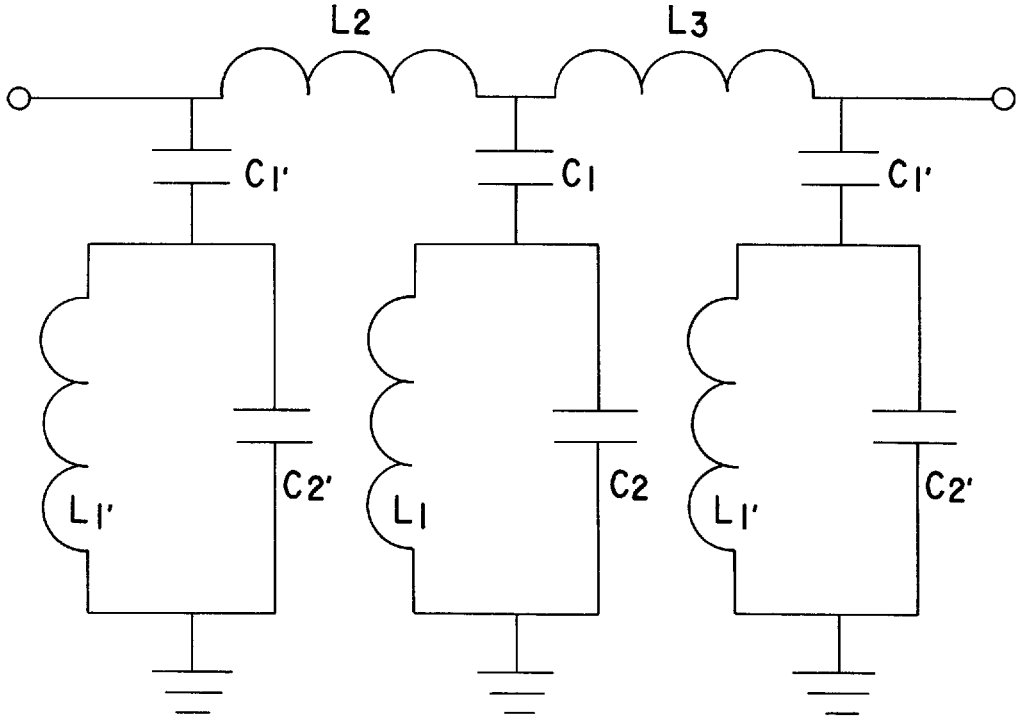
FIG. 13 is a diagram showing an equivalent circuit of the dielectric filter shown in FIG. 12.
Figure 14:
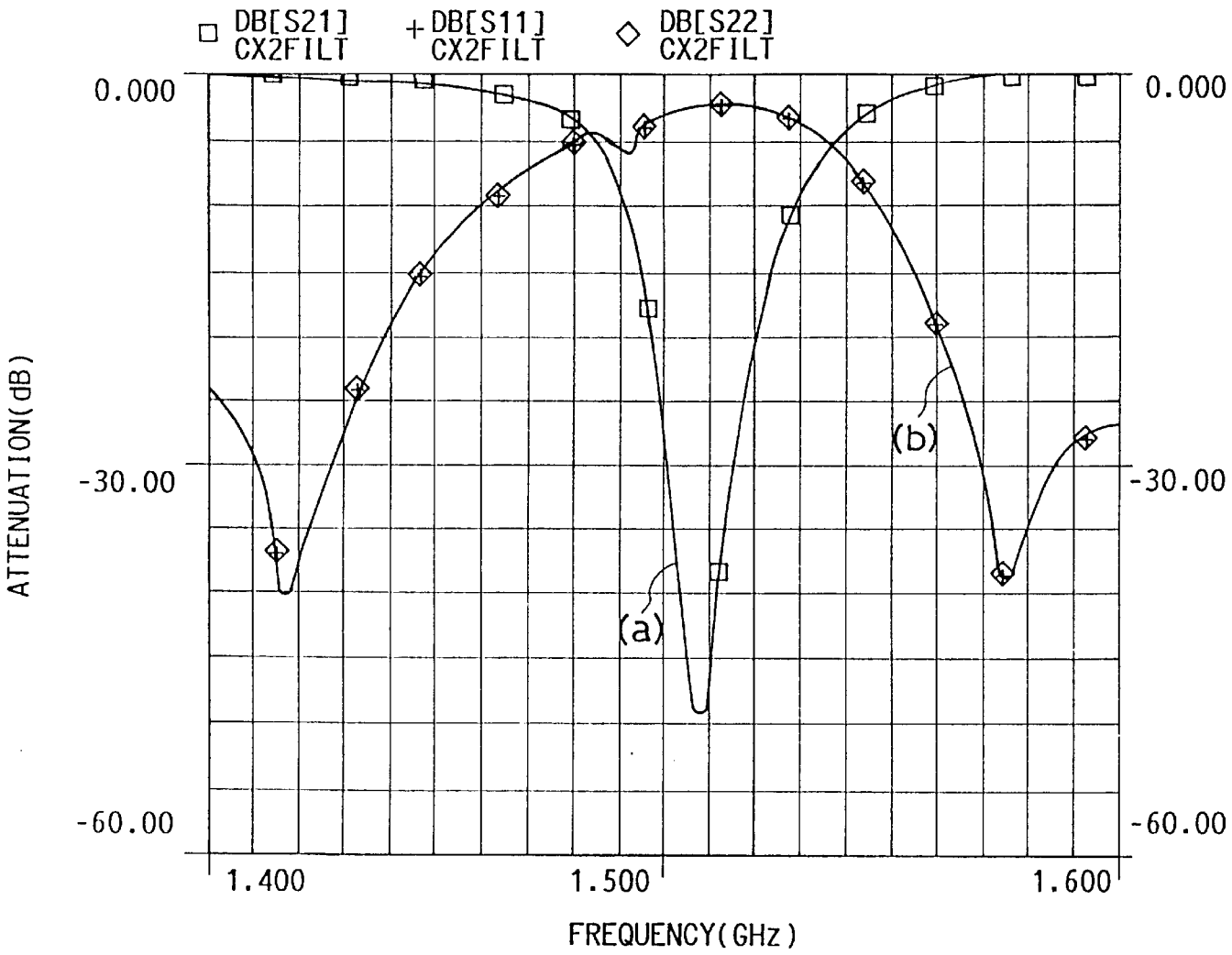
FIG. 14 is a diagram showing the representative characteristics of the dielectric filter shown in FIG. 12.

FIG. 13 is a diagram showing an equivalent circuit of the dielectric filter comprising the above described chip coils 12 and 13 of FIG. 12. In FIG. 13, $L_2$ and $L_3$ respectively indicate inductances of the chip coils 12 and 13 of FIG. 12. In addition, FIG. 14 is a diagram showing the frequency characteristics of the above described dielectric filter. A graph (a) shows the propagation characteristics of the filter, and a graph (b) shows the reflection loss. As can be seen from FIG. 13, the dielectric filter has a function of a band preventing filter. In the dielectric filter exhibiting the above described characteristics, used as the above described chip coils 12 and 13 are ones respectively having inductances $L_2$ and $L_3$ of 10 nH. In addition, the area of each of the conductors for capacitance 6 in the coaxial resonators 7 and 9 for input or output is taken as 20 $mm^2$ so that $C_1'$=2 pF, $C_2'$=7 pF, and $L_1'$=1.6 nH. The area of the conductor for capacitance 6 in the coaxial resonator 8 for purposes other than input or output is taken as 10 $mm^2$ so that $C_1$=1 pF, $C_2$=7 pF, and $L_1$=1.6 nH.

As described in the foregoing, the above described coaxial resonator comprises the conductor for capacitance 6 on the outer peripheral surface of the dielectric block 1, and this conductor for capacitance 6 provides a place where in coupling the coaxial resonators to each other by the chip capacitor 10 or 11 or the chip coil 12 or 13, the chip component is carried.

Figure 24A:
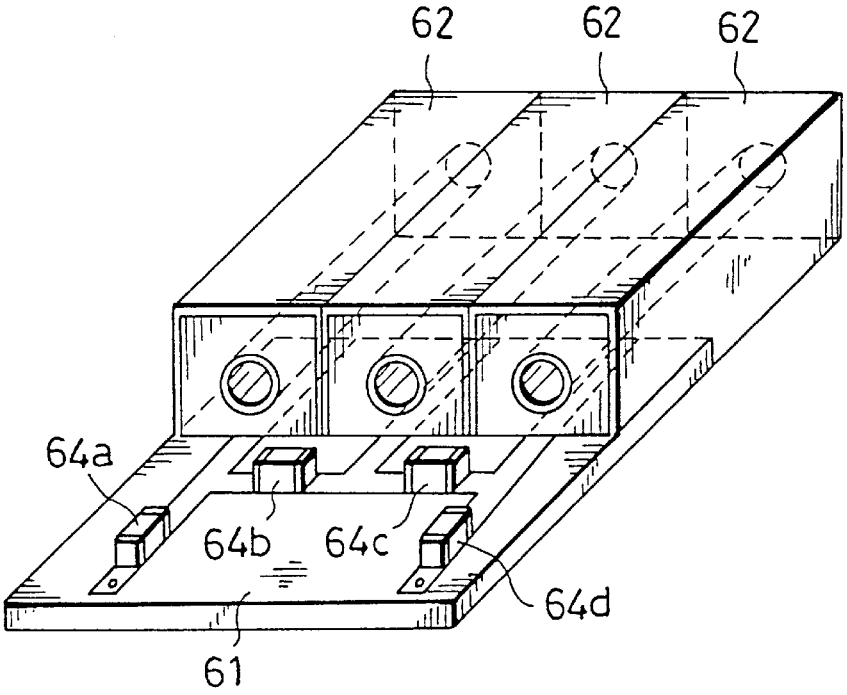
Fig. 24A Prior Art
FIG. 24A is a perspective view showing a conventional dielectric filter.
Figure 24B:
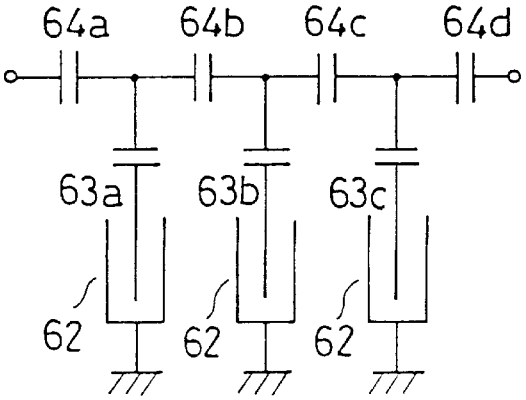
Fig. 24B Prior Art
FIG. 24B is a diagram showing an equivalent circuit thereof.

Consequently, in the dielectric filter in which a plurality of coaxial resonators as described above are provided side by side, and the above described chip capacitors 10 and 11 or the chip coils 12 and 13 are carried on the coaxial resonators to couple the coaxial resonators to each other, the necessity of using a dielectric substrate for carrying the chip capacitors in constructing the dielectric filter as a polarized filter as in the conventional example is eliminated, thereby to make it possible to miniaturize the dielectric filter. For example, the conventional dielectric filter shown in FIG. 24 is 9 mm wide×10 mm deep×3 mm high. On the other hand, the dielectric filter according to the present embodiment is 9 mm wide×7 mm deep×3 mm high. This proves that in the present embodiment, the depth is decreased and the volume is decreased by approximately 30%.

(Embodiment 3)

A third embodiment will be described with reference to FIGS. 15 to 23.

As in the above described embodiment, a dielectric block 1 is in a rectangular parallelopiped shape having dimensions of approximately 3 mm long×3 mm wide×7 mm deep, and is constituted by a dielectric member (the dielectric constant is 38) composed of, for example, ceramics of a $TiO_2$—$SnO_2$—$ZrO_2$ system. The dielectric block 1 has a through hole 2 having a diameter of 1 mm provided in the longitudinal direction in its central part. In addition, an inner peripheral surface of the above described through hole 2 is coated with a conductive member (such as, silver) in order to form an inner conductor 3. On the other hand, an outer peripheral surface of the dielectric block 1 is similarly coated with a conductive member (such as silver) in order to form an outer conductor 4. One of two end faces perpendicular to the above described through hole 2 is opened, while the other end face is short-circuited.

Figure 15:
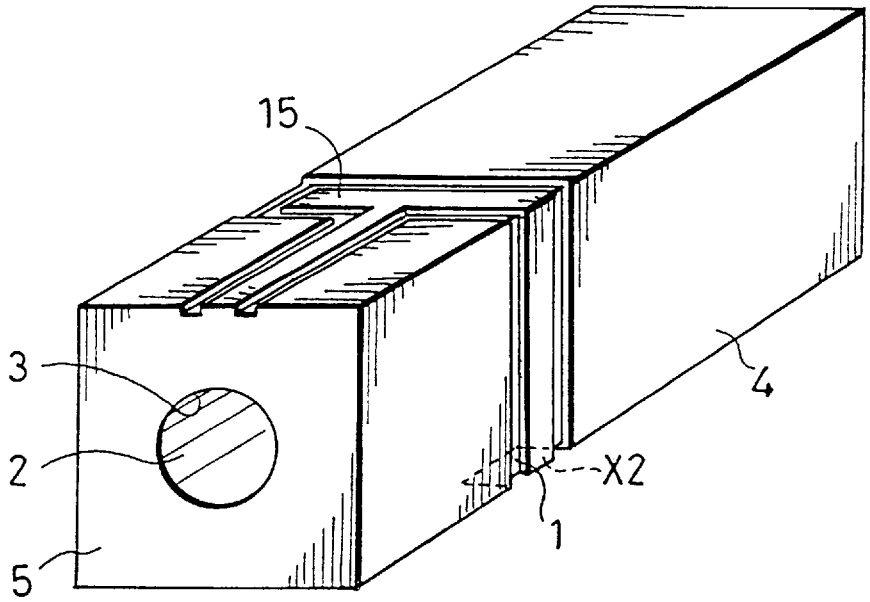
FIG. 15 is a perspective view showing a coaxial resonator which comprises a conductor for induction according to the present invention and is used for input or output.
Figure 16:
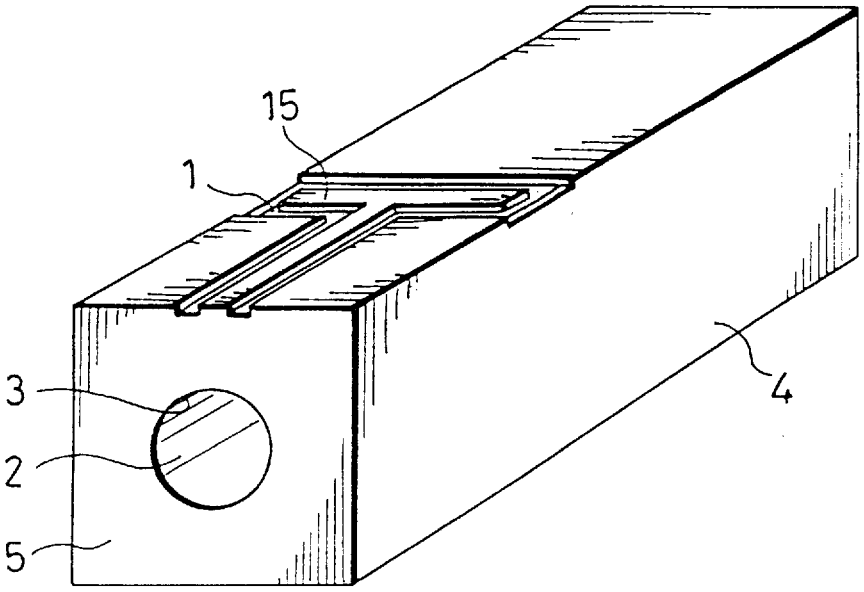
FIG. 16 is a perspective view showing a coaxial resonator which comprises a conductor for induction according to the present invention and is used for purposes other than input or output.

As shown in FIGS. 15 and 16, an independent conductor for induction 15 which is composed of a conductive member such as silver, and is brought into electrical contact with the above described inner conductor 3 through a conductor on the above described short-circuited end face and spaced apart from the above described outer conductor 4 by a distance of 0.2 mm so as not to be brought into electrical contact with the conductor 4 is formed in a position in proximity to the above described opened end face on the outer peripheral surface of the dielectric block 1. The width of the conductor for induction 15 is set to 0.2 mm. The coaxial resonator shown in FIG. 15 is for input or output, and the conductor for induction 15 is formed over two surfaces, that is, the upper surface and the side surface. On the other hand, the coaxial resonator shown in FIG. 16 is for purposes other than input or output, and the conductor for induction 15 is formed only on the upper surface. In the present embodiment, the conductor for induction 15 on the above described side surface in the coaxial resonator for input or output shown in FIG. 15 is extended to the lower end of the side surface, and a notch X2 indicated by a dotted line in FIG. 15 is formed on the bottom surface of the coaxial resonator so that the outer conductor 4 formed on the bottom surface is not brought into electrical contact with the conductor for induction 15 formed on the above described side surface. The conductor for induction 15 is thus extended to the lower end of the side surface, thereby to make it easy to connect the coaxial resonator and the other element to each other on a substrate.

In FIGS. 15 and 16, reference number 5 indicates the same part as that in FIG. 6. In FIG. 16, reference numerals 1 and 2 indicate the same parts as those in FIG. 6.

Figure 17:
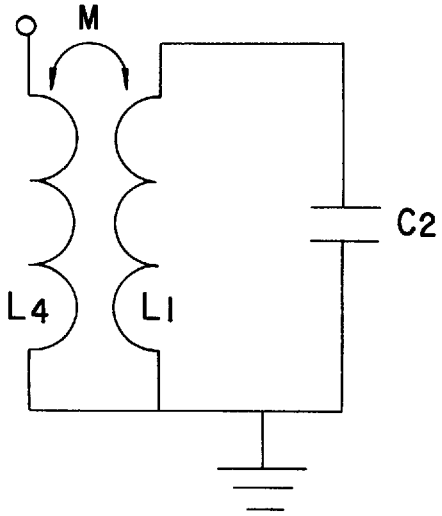
FIG. 17 is a diagram showing an equivalent circuit of the coaxial resonator comprising the conductor for induction according to the present invention.

FIG. 17 is a diagram showing an equivalent circuit of the above described coaxial resonator. In FIG. 17, M is a mutual inductance produced between a self-inductance $L_1$,$L_4$ produced by the conductor for induction 15 and the inner conductor 3 of the resonators in FIGS. 15 and 16. Specifically, since the conductor for induction 15 is formed on the side of the short-circuited end face, a magnetic field is dominant, so that the conductor for induction 15 can be regarded as substantial inductive coupling. A portion parallel to the inner conductor 3 in the conductor for induction 15 contributes to the inductive coupling, and a portion perpendicular to the inner conductor 3 in the conductor for induction 15 does not contribute to the inductive coupling because magnetic fields in the inner conductor 3 and the perpendicular portion are orthogonal to each other. Such a perpendicular portion is provided so as to couple the coaxial resonators to each other by chip components, as described later.

In FIG. 17, reference letters $C_2$ and $L_1$ indicate the same parts as those in FIG. 8.

Figure 18:
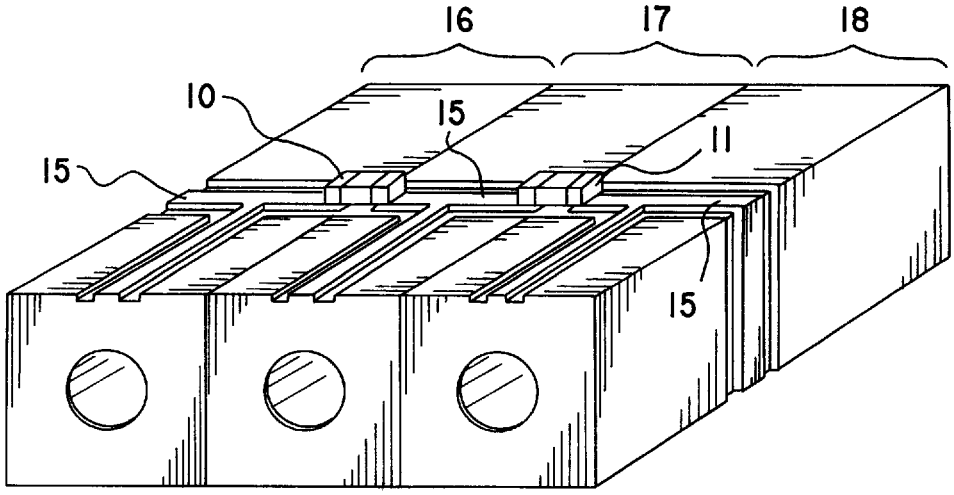
FIG. 18 is a perspective view showing a dielectric filter constructed by arranging three coaxial resonators each comprising the conductor for induction according to the present invention side by side and coupling the resonators to each other by chip capacitors.

FIG. 18 is a perspective view showing a dielectric filter constituted by three coaxial resonators, where both sides of the coaxial resonators 16 and 18 are coaxial resonators for input or output and of construction shown in FIG. 15, and the coaxial resonator 17 in the center is a coaxial resonator of construction shown in FIG. 16. Each of the coaxial resonators comprises a conductor for induction 15 on its upper surface. The conductors for induction 15 are respectively extended as electrodes for input or output on the side surfaces of the coaxial resonators 16 and 18 on both sides. A chip capacitor 10 is carried between the conductor for induction 15 in the coaxial resonator 16 and the conductor for induction 15 in the coaxial resonator 17, and a chip capacitor 11 is carried between the conductor for induction 15 in the coaxial resonator 17 and the conductor for induction 15 in the coaxial resonator 16.

Figure 19:
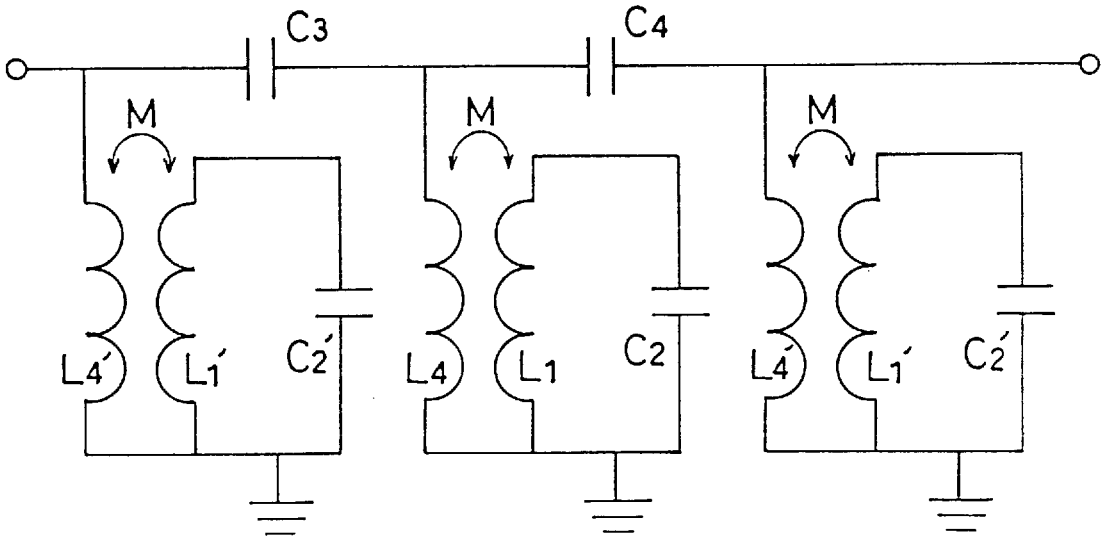
FIG. 19 is a diagram showing an equivalent circuit of the dielectric filter shown in FIG. 18.
Figure 20:
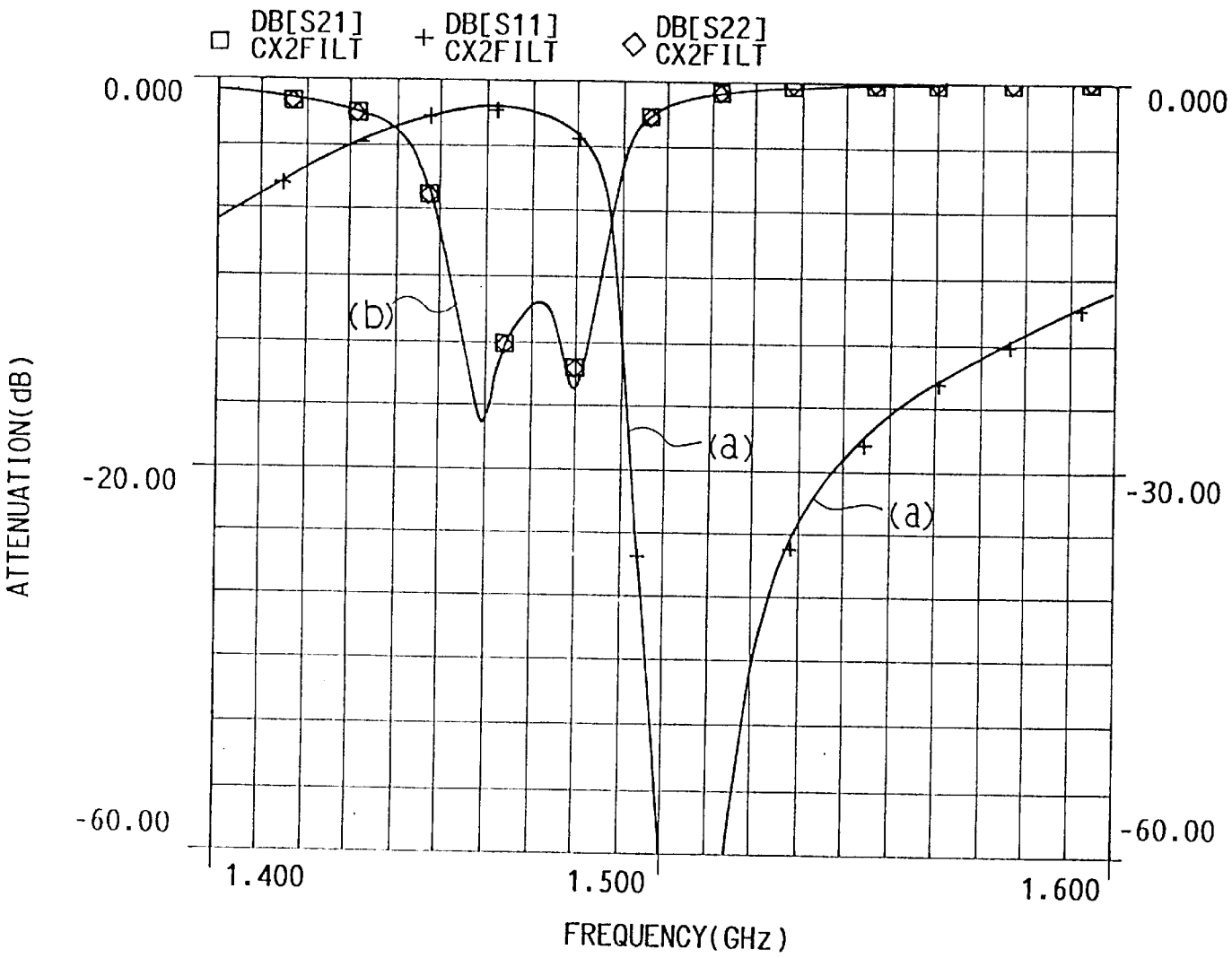
FIG. 20 is a diagram showing the representative characteristics of the dielectric filter shown in FIG. 18.

FIG. 19 is a diagram showing an equivalent circuit of the above described dielectric filter. In FIG. 19, $C_3$ and $C_4$ respectively indicate capacitances of the chip capacitors 10 and 11 of FIG. 18. In addition, FIG. 20 is a diagram showing the frequency characteristics of the above described dielectric filter. A graph (a) shows the propagation characteristics of the filter, and a graph (b) shows the reflection loss. As can be seen from FIG. 20, the dielectric filter has a function of a polarized band-pass filter. In the dielectric filter exhibiting the above described characteristics, used as the above described chip capacitors 10 and 11 are ones respectively having capacitances $C_3$ and $C_4$ of 2 pF. In addition, the length of each of portions, which are parallel to the axial direction in the coaxial resonators 16 and 18 for input or output (hereinafter referred to as parallel portions), of the conductors for induction 15 in the coaxial resonators 16 and 18 is taken as 3.5 mm so that $L_1'$=0.3 nH, $L_4'$=1 nH, and $C_2'$=7 pF. The length of a parallel portion of the conductor for induction 15 in the coaxial resonator 17 for purposes other than input or output is taken as 3.5 mm so that $L_1$=1.6 nH, $L_4$=1 nH, and $C_2$=7 pF (see, FIG. 19).

Figure 21:
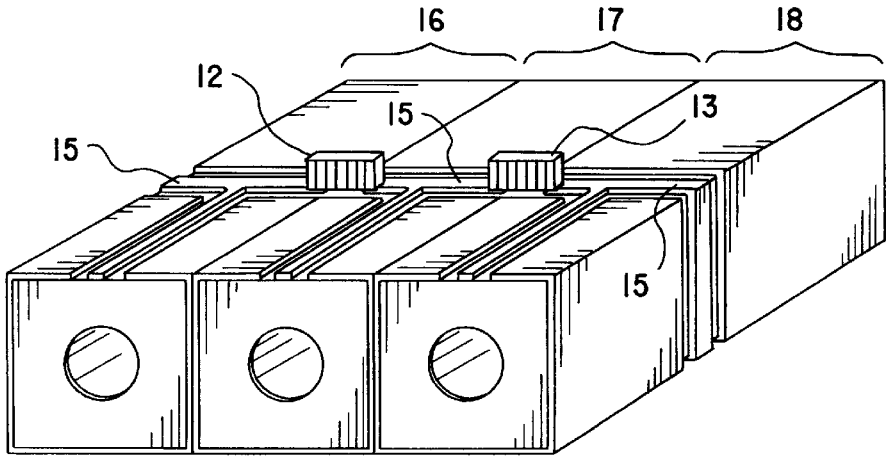
FIG. 21 is a perspective view showing a dielectric filter constructed by arranging three coaxial resonators each comprising the conductor for induction according to the present invention side by side and coupling the resonators to each other by chip coils.

FIG. 21 is a perspective view showing a dielectric filter using chip coils 12 and 13 as reactance. Specifically, the chip coil 12 is carried between the conductor for induction 15 in the coaxial resonator 16 and the conductor for induction 15 in the coaxial resonator 17, and the chip coil 13 is carried between the conductor for induction 15 in the coaxial resonator 17 and the conductor for induction 15 in the coaxial resonator 18.

Figure 22:
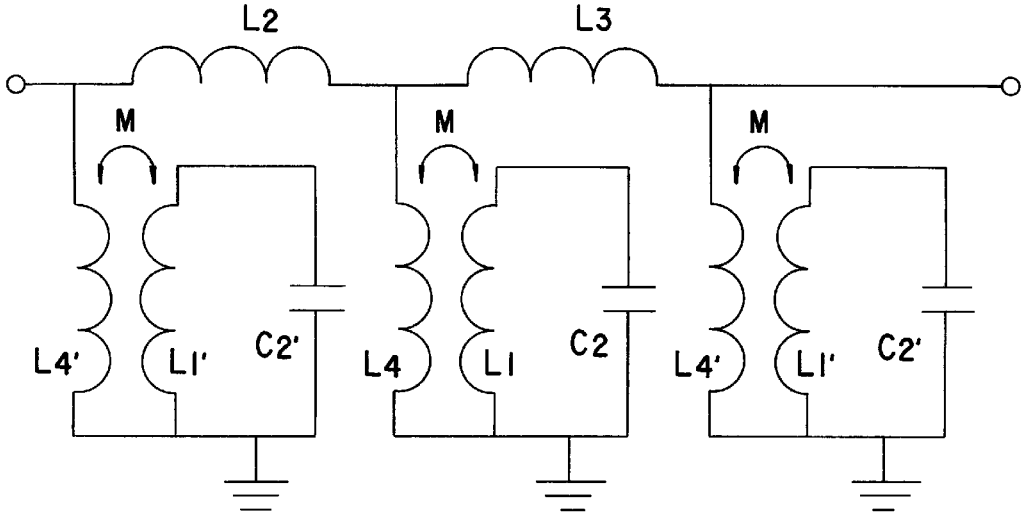
FIG. 22 is a diagram showing an equivalent circuit of the dielectric filter shown in FIG. 21.
Figure 23:
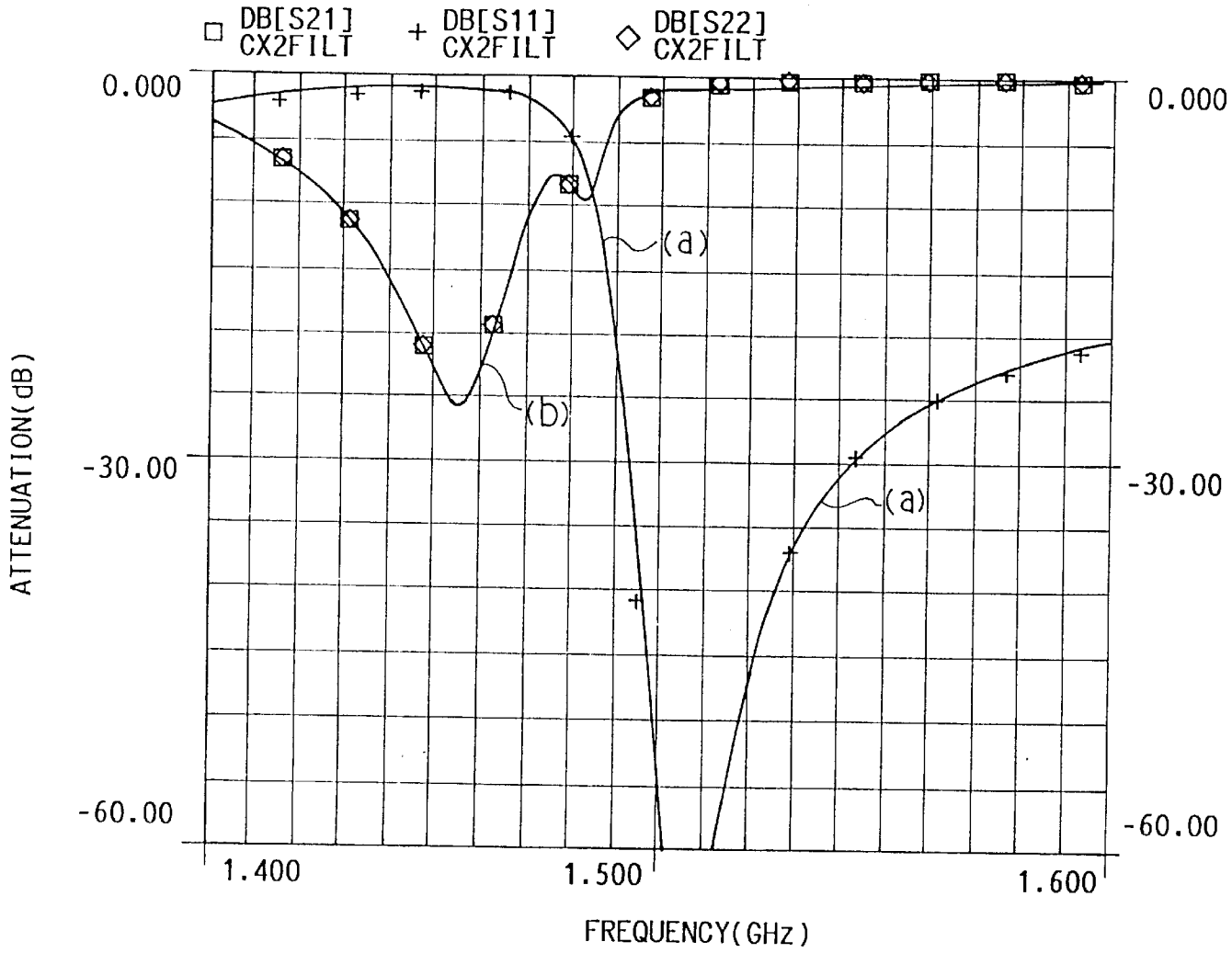
FIG. 23 is a diagram showing the representative characteristics of the dielectric filter shown in FIG. 21.

FIG. 22 is a diagram showing an equivalent circuit of the dielectric filter comprising the above described chip coils 12 and 13 of FIG. 21. In FIG. 22, $L_2$ and $L_3$ respectively indicate inductances of the chip coils 12 and 13. In addition, FIG. 23 is a diagram showing the frequency characteristics of the above described dielectric filter. A graph (a) shows the propagation characteristics of the filter, and a graph (b) shows the reflection loss. As can be seen from FIG. 22, the dielectric filter has a function of a polarized band-pass filter. In the dielectric filter exhibiting the above described characteristics, used as the above described chip coils 12 and 13 are ones respectively having inductances $L_2$ and $L_3$ of 10 nH. In addition, the length of each of parallel portions of the conductors for induction 15 in the coaxial resonators 16 and 18 for input or output is taken as 3.5 mm so that $L_1'$=1.6 nH, $L_4'$=1.0 nH, and $C_2'$=7 pF. The length of a parallel portion of the conductor for induction 15 in the coaxial resonator 17 for purposes other than input or output is taken as 3.5 mm so that $L_1$=1.6 nH, $L_4$=1 nH, and $C_2$=7 pF (see, FIG. 22).

In FIGS. 19 and 22, reference letter M indicates the same part as that in FIG. 17.

As described in the foregoing, the coaxial resonator according to the present invention comprises the conductor for capacitance or the conductor for induction on the outer peripheral surface of the dielectric block, and this conductor provides a place where in coupling the coaxial resonators to each other by a chip component, the chip component is carried.

Consequently, in the dielectric filter in which a plurality of coaxial resonators as described above are provided side by side, and the above described chip components are carried on the coaxial resonators to couple the coaxial resonators to each other, the necessity of using a dielectric substrate for carrying the chip components in constructing the dielectric filter as a polarized filter as in the conventional example is eliminated, thereby to make it possible to miniaturize the dielectric filter.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A coaxial resonator, comprising:

a dielectric block having at least four side surfaces, each of said at least four side surfaces having a respective outer peripheral surface and said dielectric block having a respective inner peripheral surface, each said respective outer peripheral surface and said respective inner peripheral surface being parallel to each other along a common axis, and said dielectric block further having first and second end faces crossing said axis;

first and second layers of a conductor coating respectively disposed on said respective outer peripheral surface and said respective inner peripheral surface;

a third conductor layer disposed on said second end face for short-circuiting said first and second conductor layers; and an input electrode and an output electrode, respectively disposed on the respective outer peripheral surface in a position in proximity to said first end face, said input and output electrodes not being brought into electrical contact with said first conductor layer and being independent of each other, wherein said input electrode and said output electrode are capacitively coupled to each other to thereby improve frequency characteristics of said coaxial resonator, wherein said input electrode and said output electrode are adjacent each other absent said first layer existing therebetween, wherein said input electrode and said output electrode are directly coupled to each other, and wherein said input and output electrodes are disposed substantially on a common outer peripheral surface.

2. The coaxial resonator according to claim 1, wherein respective portions of said input electrode and said output electrode are extended to side surfaces among the at least four side surfaces, which are respectively adjacent to the respective input electrode and the respective output electrode, of said dielectric block.

3. The coaxial resonator according to claim 1, wherein said dielectric block is comprised of ceramics of a $TiO_2$—$SnO_2$—$ZrO_2$ system.

4. The coaxial resonator according to claim 1, wherein at least one of said first conductor layer and said second conductor layer is comprised of silver.

5. A dielectric filter in which a plurality of coaxial resonators are provided side by side, wherein each of said coaxial resonators comprises:

a respective dielectric block having at least four side surfaces, each of said at least four side surfaces having a respective outer peripheral surface and said respective dielectric block having a respective inner peripheral surface, each said respective outer peripheral surface and said respective inner peripheral surface being parallel to each other along a common axis, and said respective dielectric block further having first and second end faces crossing said axis, first and second layers of a conductor coating respectively disposed on said respective outer peripheral surface and said respective inner peripheral surface, a third conductor layer disposed on said respective second end face for short-circuiting said corresponding first and second conductor layers, and a respective input electrode and a respective output electrode respectively disposed on the respective outer peripheral surface in a position in proximity to said first end face, said input and output electrodes not being brought into electrical contact with said corresponding first conductor layer and being independent of each other, said dielectric filter comprising means for positioning a plane of the input electrode and a plane of the output electrodes in said respective coaxial resonators in a common plane, thereby arranging the first end faces and the second end faces in said respective coaxial resonators in a similar direction along said common axis, and electrically connecting said respective input electrode and said respective output electrode of the adjacent coaxial resonators to each other, wherein said input electrode and said output electrode are capacitively coupled to each other to thereby improve frequency characteristics of a respective one of said coaxial resonators, wherein said respective input electrode and said respective output electrode are adjacent each other absent said first layer existing therebetween, wherein said respective input electrode and said respective output electrode are directly coupled to each other, and wherein said respective input and output electrodes are disposed substantially on a common respective outer peripheral surface of a corresponding coaxial resonator.

6. The dielectric filter according to claim 5, wherein said means for electrically connecting said input electrode to said output electrode of the adjacent coaxial resonator to each other extends towards respective portions of said respective input electrode and said respective output electrode to side surfaces among the at least four side surfaces, which are respectively adjacent to the input electrode and the output electrode, of said dielectric block, and wherein the extended portions are in close contact with each other.

7. The dielectric filter according to claim 6, wherein said respective input electrode and said respective output electrode are provided on a bottom surface of a respective one of said coaxial resonator.

8. The dielectric filter according to claim 6, wherein the respective extended portions of the input electrode and the output electrode in the adjacent coaxial resonators are in close contact with each other.

9. A method of adjusting coupling capacitances in a coaxial resonator including a dielectric block having at least four side surfaces, each of said at least four side surfaces having a respective outer peripheral surface and said dielectric block having a respective inner peripheral surface, each said respective outer peripheral surface and said respective inner peripheral surface being parallel to each other along a common axis, and said dielectric block further having first and second end faces crossing said axis, first and second conductor layers with which said respective outer peripheral surface and said respective inner peripheral surface are respectively coated, a third conductor layer on said second end face for short-circuiting said first and second conductor layers, and an input electrode and an output electrode which are formed on the respective outer peripheral surface in a position in proximity to said first end face, are not brought into electrical contact with said first conductor layer, and are independent of each other, said method comprising the steps of:

changing areas of at least one of said input electrode and said output electrode in said coaxial resonator; and adjusting coupling capacitances of at least one of said input electrode and said output electrode and said second conductor layer, wherein said step of adjusting coupling capacitances includes the step of capacitively coupling said input electrode and said output electrode to each other to thereby improve frequency characteristics of said coaxial resonator, wherein said input electrode and said output electrode are adjacent each other absent said first layer existing therebetween, wherein said input electrode and said output electrode are directly coupled to each other, and wherein said input and output electrodes are disposed substantially on a common outer peripheral surface.

10. The method according to claim 9, wherein respective portions of said respective input electrode and said respective output electrode extend to side surfaces among the at least four side surfaces, which are respectively adjacent to the respective input electrode and the respective output electrode, of said dielectric block.

* * * * *